US011196235B2

(12) United States Patent
Ota et al.

(10) Patent No.: US 11,196,235 B2
(45) Date of Patent: Dec. 7, 2021

(54) ELECTRODE MATERIAL SPARK PLUG ELECTRODE, AND SPARK PLUG

(71) Applicant: SUMITOMO ELECTRIC INDUSTRIES, LTD., Osaka (JP)

(72) Inventors: Hajime Ota, Osaka (JP); Yasuhisa Uehara, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 130 days.

(21) Appl. No.: 16/613,965

(22) PCT Filed: Feb. 7, 2018

(86) PCT No.: PCT/JP2018/004116
§ 371 (c)(1),
(2) Date: Nov. 15, 2019

(87) PCT Pub. No.: WO2018/211752
PCT Pub. Date: Nov. 22, 2018

(65) Prior Publication Data

US 2021/0242665 A1 Aug. 5, 2021

(30) Foreign Application Priority Data

May 19, 2017 (JP) ..... JP2017-100387

(51) Int. Cl.
*H01T 13/39* (2006.01)
*H01T 13/20* (2006.01)

(52) U.S. Cl.
CPC ..... *H01T 13/39* (2013.01); *H01T 13/20* (2013.01)

(58) Field of Classification Search
CPC ..... H01T 13/32; H01T 13/39
See application file for complete search history.

(56) References Cited

U.S. PATENT DOCUMENTS 6,121,719 A * 9/2000 Matsutani ..... H01T 13/39 313/141
2007/0216275 A1* 9/2007 Torii ..... H01T 13/36 313/141
2013/0009536 A1* 1/2013 Kadowaki ..... H01T 13/39 313/141
2015/0222096 A1* 8/2015 Nakayama ..... H01T 13/32 313/142
2018/0166863 A1* 6/2018 Sumoyama, Sr. ..... H01T 21/02
2018/0363102 A1* 12/2018 Ota ..... H01T 13/39

FOREIGN PATENT DOCUMENTS

CN 104979753 A * 10/2015 ..... H01T 13/32
JP H05-13148 A 1/1993
JP H10-511804 A 11/1998
(Continued)

*Primary Examiner* — Mariceli Santiago
(74) *Attorney, Agent, or Firm* — Faegre Drinker Biddle & Reath LLP

(57) ABSTRACT

An electrode material includes a composite including a core wire that is composed of a nickel base material containing 96% by mass or more of Ni and a covering that covers an outer peripheral surface of the core wire and that does not cover but exposes an end face of the core wire. The covering is composed of a nickel alloy containing 10% by mass or more and 30% by mass or less of Cr and 0.1% by mass or more and 6% by mass or less of Al. The composite has a specific resistance of less than 50 μΩ·cm.

19 Claims, 3 Drawing Sheets

(56) References Cited

FOREIGN PATENT DOCUMENTS

| | | | | | |
|---|---|---|---|---|---|
| JP | 2003-197347 | A | | 7/2003 | |
| JP | 2012-69393 | A | | 4/2012 | |
| JP | 2013-33713 | A | | 2/2013 | |
| JP | 2013-127911 | A | | 6/2013 | |
| JP | 2015118770 | A | * | 6/2015 | ..... H01T 13/39 |
| JP | 2015198053 | A | * | 11/2015 | ..... H01T 21/02 |
| JP | 2020004699 | A | * | 1/2020 | |
| WO | WO-97/00547 | A1 | | 1/1997 | |
| WO | WO-2015/093003 | A1 | | 6/2015 | |

* cited by examiner

ELECTRODE MATERIAL SPARK PLUG ELECTRODE, AND SPARK PLUG

TECHNICAL FIELD

The present invention relates to an electrode material, a spark plug electrode, and a spark plug. The present application claims priority from Japanese Patent Application No. 2017-100387 filed on May 19, 2017, and the entire contents of the Japanese patent application are incorporated herein by reference.

BACKGROUND ART

A spark plug is one example of an engine part of an automobile or the like. Patent Literature 1 discloses, as an electrode material suitable for an electrode included in a spark plug, an electrode material composed of a nickel alloy having a specific composition.

CITATION LIST

Patent Literature

PTL 1: Japanese Unexamined Patent Application Publication No. 2012-069393

SUMMARY OF INVENTION

Solution to Problem

An electrode material according to the present disclosure includes a composite including a core wire that is composed of a nickel base material containing 96% by mass or more of Ni and a covering that covers an outer peripheral surface of the core wire and that does not cover but exposes an end face of the core wire, in which the covering is composed of a nickel alloy containing 10% by mass or more and 30% by mass or less of Cr and 0.1% by mass or more and 6% by mass or less of Al, and the composite has a specific resistance of less than 50 μΩ·cm.

A spark plug electrode according to the present disclosure is composed of the electrode material according to the present disclosure.

A spark plug according to the present disclosure includes the spark plug electrode according to the present disclosure.

DESCRIPTION OF EMBODIMENTS

Problems to be Solved by Invention

Figure 1:
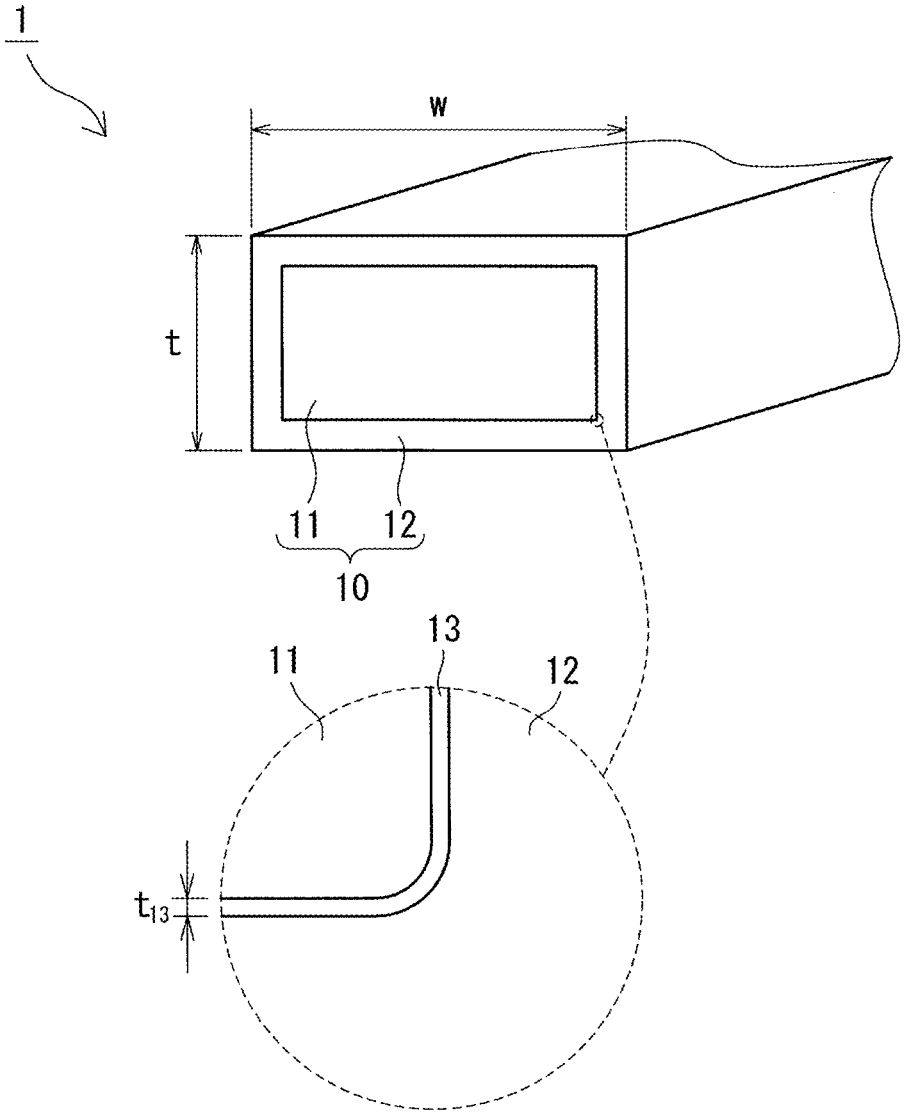
FIG. 1 is a schematic perspective view illustrating an electrode material according to an embodiment.

It is desired that an electrode included in the spark plug and an electrode material of the electrode have both higher sparking wear resistance and higher oxidation resistance.

The electrode material described in Patent Literature 1 is composed of a nickel alloy having a specific composition and thereby achieves good high temperature oxidation resistance and good sparking wear resistance. Recently, a further reduction in the thickness (reduction in the cross sectional area) of an electrode of the spark plug has been required. To produce a spark plug electrode capable of meeting such a requirement, an electrode material having both higher sparking wear resistance and higher oxidation resistance is desired.

In view of this, an object of the present invention is to provide an electrode material having both good sparking wear resistance and good oxidation resistance. Another object of the present invention is to provide a spark plug electrode and a spark plug that have both good sparking wear resistance and good oxidation resistance.

Advantageous Effects of Invention

The electrode material, the spark plug electrode, and the spark plug according to the present disclosure have both good sparking wear resistance and good oxidation resistance.

DESCRIPTION OF EMBODIMENTS OF PRESENT INVENTION

First, embodiments according to the present invention will be listed and described.

(1) An electrode material according to an embodiment of the present invention includes a composite including a core wire that is composed of a nickel base material containing 96% by mass or more of Ni and a covering that covers an outer peripheral surface of the core wire and that does not cover but exposes an end face of the core wire, in which the covering is composed of a nickel alloy containing 10% by mass or more and 30% by mass or less of Cr and 0.1% by mass or more and 6% by mass or less of Al, and the composite has a specific resistance of less than 50 μΩ·cm.

The electrode material is not composed of a single material but includes a composite having a multilayered structure composed of a plurality of different materials. In the composite, a core wire located inside is composed of a nickel base material having a high Ni content and thus has a good electrical conductivity and a low specific resistance. In the composite, a covering located outside is composed of a nickel alloy containing Cr and Al in specific ranges and thus has good oxidation resistance. The presence of the core wire having a low specific resistance enables the specific resistance of the composite to be decreased compared with an electrode material having a composition of a covering alone. The presence of the covering having good oxidation resistance provides the composite with good oxidation resistance compared with an electrode material having a composition of a core wire alone. The covering is present outside the core wire and can protect the core wire from the external environment. This also provides the composite with good oxidation resistance. Furthermore, since both the core wire and the covering contain Ni as a main component and contain the main component in common, the core wire and the covering easily adhere to each other. In this electrode material, although the core wire, which is more easily oxidized than the covering, is exposed from an end face of the composite, it is possible to suppress the progress of oxidation from the end face to the inside of the composite along the interface between the core wire and the covering. This also provides the electrode material with good oxidation resistance. Consequently, according to the electrode material described above, it is possible to form a spark plug electrode having a low specific resistance, good sparking wear resistance, and good oxidation resistance.

According to the electrode material, good thermal conductivity is also achieved because the core wire is composed of the nickel base material. Furthermore, according to the electrode material, since the core wire is exposed at an end face of the electrode material, heat can be uniformly conducted over the entire length of the composite compared with the case where the end face is covered with a constituent material of the covering. According to this electrode material, heat is unlikely to be accumulated inside the electrode material, a decrease in strength caused by maintaining the electrode material at a high temperature can also be reduced, and high-temperature strength is also good. Accordingly, when a spark plug electrode in which a core wire is exposed at an end face is formed by using the electrode material, the electrode can uniformly conduct heat from the end face over the entire length thereof and has good heat dissipation ability. Furthermore, according to the electrode material, although the core wire has a high Ni content, the electrode material has good corrosion resistance because the covering that covers the core wire contains a relatively large amount of Cr. As described above, the electrode material has good adhesion between the core wire and the covering, and it is possible to suppress the progress of corrosion from an end face of the composite to the inside of the composite along the interface between the core wire and the covering. This also provides the electrode material with good corrosion resistance.

(2) According to an embodiment of the electrode material, in a cross section of the composite, an area ratio of a cross sectional area of the covering to a cross sectional area of the composite is 0.4 or more and 0.7 or less. Hereinafter, the area ratio may be referred to as a covering ratio. The cross section refers to a section when the composite is cut along, as a cutting plane, a plane orthogonal to an axial direction of the composite or the core wire.

In the above-described embodiment, since the covering ratio is within the above specific range, the composite has a well-balanced effect of both good oxidation resistance due to the presence of the covering and good sparking wear resistance due to the presence of the core wire. In the above-described embodiment, the covering ratio is not excessively large, and thus good workability is provided in the manufacturing process, and manufacturability of the composite is also good.

(3) According to an embodiment of the electrode material, a ratio of a grain size of the nickel base material that forms the core wire to a grain size of the nickel alloy that forms the covering is 5 or more. Hereinafter, the ratio may be referred to as a ratio (core wire/covering).

In the above-described embodiment, the nickel base material that forms the core wire includes relatively coarse crystal grains, and the nickel alloy that forms the covering includes relatively fine crystal grains. Since the core wire has a coarse crystal structure, the specific resistance is easily reduced. Since the covering has a fine crystal structure, oxidation resistance is easily enhanced. That is, the specific resistance of the core wire can be reduced in terms of not only the composition but also the structure, and the oxidation resistance of the covering can be enhanced in terms of not only the composition but also the structure. Accordingly, the above-described embodiment has a low specific resistance, higher sparking wear resistance, and higher oxidation resistance.

(4) According to an embodiment of the electrode material, the electrode material includes a diffusion layer between the core wire and the covering, in which a Ni content of the diffusion layer changes in a gradient manner. Details of the diffusion layer will be described later.

The above-described embodiment has better adhesion between the core wire and the covering due to the presence of the diffusion layer. Accordingly, the above-described embodiment more easily suppresses the progress of oxidation and the progress of corrosion to the inside as described above and thus has higher oxidation resistance.

(5) According to an embodiment of the electrode material, at least one of the nickel base material that forms the core wire and the nickel alloy that forms the covering contains 0.01% by mass or more and 0.7% by mass or less, in total, of a rare earth element.

Since the above-described embodiment contains a rare earth element (which may be one element or two or more elements) within the above specific range, oxidation resistances of the core wire and the covering can be further enhanced.

(6) According to an embodiment of the electrode material, the nickel alloy that forms the covering contains, in terms of % by mass, 0.1% or more and 1.5% or less of Si,
0.1% or more and 0.6% or less of Mn,
10% or more and 30% or less of Cr,
0.1% or more and 6% or less of Al,
0.01% or more and 12% or less of Fe, and
0.01% or more and 0.6% or less of Ti, with the balance being Ni and inevitable impurities.

Since the above-described embodiment includes a covering composed of a nickel alloy that contains, in addition to Cr and Al, Si, Mn, Fe, and Ti within the above specific ranges, oxidation resistance is further enhanced.

(7) According to an embodiment of the electrode material, the nickel base material that forms the core wire contains, in terms of % by mass, 0.01% or more and 1.5% or less of Si,
0% or more and 1.5% or less of Mn,
0.001% or more and 1.5% or less of Cr,
0.001% or more and 0.5% or less of Al,
0.01% or more and 1.5% or less of Fe, and
0% or more and 0.5% or less of Ti, with the balance being Ni and inevitable impurities.

Since the above-described embodiment includes a core wire composed of a nickel base material that contains Si, Cr, Al, Fe, and optionally Mn and Ti within the above specific ranges, an increase in the specific resistance and a decrease in the thermal conductivity due to the incorporation of the above elements are suppressed to provide good sparking wear resistance and good thermal conductivity, oxidation resistance is also enhanced to a certain extent, and consequently, higher oxidation resistance is achieved.

(8) A spark plug electrode according to an embodiment of the present invention is composed of the electrode material according to any one of (1) to (7) above.

Since the spark plug electrode is composed of the electrode material that includes the specific composite described above, the spark plug electrode also has a low specific resistance of less than 50 μΩ·cm, good sparking wear resistance, and good oxidation resistance, as described above. In the spark plug electrode, the core wire included in the composite may be exposed at an end face of the electrode. Even when the core wire is exposed at the end face, as described above, adhesion between the core wire and the covering that covers the outer peripheral surface of the core wire is good, and thus oxidation is unlikely to proceed to the inside. Accordingly, the spark plug electrode has good oxidation resistance.

In addition, according to the spark plug electrode, when the core wire is exposed at an end face of the electrode, heat can be uniformly conducted from the end face over the entire length of the electrode, and good heat dissipation ability is also achieved, as described above. Furthermore, the spark plug electrode also has good corrosion resistance because the core wire is covered with the covering, and adhesion between the core wire and the covering is good, as described above.

(9) A spark plug according to an embodiment of the present invention includes the spark plug electrode according to (8) above.

Since the spark plug includes the spark plug electrode described above, the spark plug also has good sparking wear resistance and good oxidation resistance, as described above.

Details of Embodiments of Present Invention

Embodiments according to the present invention will now be specifically described with reference to the drawings as needed. The contents of elements are represented in units of % by mass unless otherwise noted.

[Electrode Material]

(Outline)

An electrode material 1 according to an embodiment is a metal wire rod having a two-layer structure that includes inner and outer layers, as illustrated in FIG. 1. This electrode material 1 is used for electrodes 20 (FIG. 2) included in a spark plug 2 (the same) used in an engine of an automobile or the like. The electrode material 1 according to the embodiment includes a composite 10 that includes a core wire 11 and a covering 12 that covers an outer peripheral surface of the core wire 11 and that does not cover but exposes an end face of the core wire 11. The core wire 11 and the covering 12 each contain Ni as a main component (component having the highest content by mass), although they are composed of metals having different compositions. The core wire 11 is composed of a nickel base material containing 96% by mass or more of Ni. The covering 12 is composed of a nickel alloy containing 10% by mass or more and 30% by mass or less of Cr and 0.1% by mass or more and 6% by mass or less of Al. In the electrode material 1 according to the embodiment, the composite 10 has a specific resistance of less than 50 μΩ·cm.

(Composition)

In the composite 10 that forms the electrode material 1, both the core wire 11 and the covering 12 contain Ni as a main component. Therefore, a heterogeneous phase is unlikely to be formed near the interface between the core wire 11 and the covering 12, and thus good adhesion between the core wire 11 and the covering 12 is realized. In particular, since the nickel base material that forms the core wire 11 has a Ni content of 96% by mass or more, the nickel base material has a low specific resistance and contributes to a reduction in the specific resistance of the composite 10. The high Ni content provides a good thermal conductivity, enables heat dissipation ability of the composite 10 to be enhanced, provides good plastic workability, and facilitates the manufacture of the composite 10 having a two-layer structure. On the other hand, since the nickel alloy that forms the covering 12 contains Cr and Al, which contribute to the improvement in oxidation resistance, within specific ranges, the nickel alloy contributes to the improvement in oxidation resistance of the composite 10. In the electrode material 1 according to the embodiment, the core wire 11, which has poor oxidation resistance, is covered with the covering 12 to thereby suppress oxidation of the core wire 11, and the above-described effects due to the presence of the core wire 11 are appropriately achieved. In addition, while the electrode material 1 according to the embodiment includes the covering 12, which contains Cr in a slightly large amount and tends to have a high specific resistance, good sparking wear resistance is achieved by adjusting, for example, the composition of the covering 12 and the ratio of the covering 12 in the composite 10 (covering ratio described later) within a range in which the specific resistance of the composite 10 satisfies less than 50 μΩ·cm.

<Core Wire>

Examples of the nickel base material that forms the core wire 11 include nickel alloys having various compositions in which the Ni content is 96% by mass or more or pure nickel. With an increase in the Ni content, the specific resistance is easily reduced. The Ni content can be 96.5% by mass or more, and further, 97% by mass or more.

An example of the nickel base material that forms the core wire 11 is a nickel alloy having a composition (1) below. The effects achieved by incorporating respective elements will be described below (regarding Cr and Al, refer to the section of the covering). With a decrease in the contents of respective elements listed below, the specific resistance tends to be easily decreased, and the thermal conductivity tends to be easily increased. With an increase in the contents, for example, oxidation resistance and high-temperature strength tend to be easily enhanced (the same applies to respective elements contained in the nickel alloy that forms the covering 12 described below).

Composition (1): The nickel alloy contains 0.01% by mass or more and 1.5% by mass or less of Si, 0% by mass or more and 1.5% by mass or less of Mn, 0.001% by mass or more and 1.5% by mass or less of Cr, 0.001% by mass or more and 0.5% by mass or less of Al, 0.01% by mass or more and 1.5% by mass or less of Fe, and 0% by mass or more and 0.5% by mass or less of Ti, with the balance being Ni and inevitable impurities.

The nickel alloy may further contain 0.01% by mass or more and 0.7% by mass or less, in total, of a rare earth element. Examples of the rare earth element include Y and lanthanides (for example, La, Ce, and Yb), and one or two or more elements may be contained (the same applies to the nickel alloy that forms the covering 12 described below).

In the nickel alloy having the composition (1) above, Mn, Ti, and a rare earth element are not essential. The nickel alloy that forms the core wire 11 has a low specific resistance because the number of essential elements is small as described above and the contents of the respective elements are slightly lower than those of the covering 12 described below. In addition, since the nickel alloy contains the above elements within the above specific ranges, oxidation resistance is also good to a certain extent.

The contents of the elements in the nickel alloy having the composition (1) can be as follows while anticipating, for example, a decrease in the specific resistance and improvements in the thermal conductivity and oxidation resistance.

Si: 0.03% by mass or more and 1.3% by mass or less, further, 0.05% by mass or more and 1.2% by mass or less Mn: 0.01% by mass or more and 1.3% by mass or less, further, 0.1% by mass or more and 1.2% by mass or less, Cr: 0.001% by mass or more and 1.4% by mass or less, further, 0.001% by mass or more and 1.3% by mass or less Al: 0.001% by mass or more and 0.4% by mass or less, further, 0.001% by mass or more and 0.3% by mass or less Fe: 0.02% by mass or more and 1.3% by mass or less, further, 0.03% by mass or more and 1.2% by mass or less Ti: 0.01% by mass or more and 0.5% by mass or less, further, 0.03% by mass or more and 0.3% by mass or less Rare earth element: 0.05% by mass or more and 0.68% by mass or less in total, further, 0.08% by mass or more and 0.65% by mass or less in total <Covering>

The nickel alloy that forms the covering 12 contains Cr and Al as essential elements. This nickel alloy contains Ni in an amount of more than 50% by mass, typically, 60% by mass or more and contains Ni as a main component, although the Ni content of this nickel alloy is lower than that of the nickel base material that forms the core wire 11.

Chromium (Cr) has an antioxidant effect, in particular, an effect of suppressing internal oxidation and is less likely to increase the specific resistance than Al. Accordingly, the nickel alloy that forms the covering 12 has a Cr content of 10% by mass or more and contains Cr in a slightly large amount. Chromium further has an effect of improving corrosion resistance. With an increase in the Cr content, oxidation resistance and corrosion resistance enhance. The Cr content can be 12% by mass or more, further, 13% by mass or more, and 14% by mass or more. At a Cr content of 30% by mass or less, an increase in the specific resistance is reduced.

With a decrease in the Cr content, the specific resistance is easily decreased. The Cr content can be 29% or less, further, 28% or less, and 27% or less.

Aluminum (Al) is an element having a high antioxidant effect. In the case where Al is contained, when a spark plug electrode composed of the electrode material 1 is used as a spark plug, an oxide (oxide film) that contains Al can be generated afterwards on the surface of the electrode. This oxide film easily suppresses oxidation to the inside of the electrode. When Si is contained together with Al, an oxide film that contains Al and Si is easily formed, and the antioxidant effect can be further enhanced. At an Al content of 0.1% by mass or more, a high antioxidant effect is exhibited. With an increase in the Al content, oxidation resistance enhances. The Al content can be 0.2% by mass or more, further, 2.5% by mass or more. When the Al content is 6% by mass or less, an increase in the specific resistance and peeling, damage, or the like of the oxide film due to an increase in the thickness of the oxide film can be reduced, and the antioxidant effect due to the presence of the oxide film is easily exhibited. With a decrease in the Al content, the specific resistance is easily decreased, and, for example, the increase in the thickness of the oxide film is easily reduced. Accordingly, the Al content can be 5.5% by mass or less, further, 5% by mass or less.

An example of the nickel alloy that forms the covering 12 is one having a composition (2) below.

Composition (2): The nickel alloy contains 0.1% by mass or more and 1.5% by mass or less of Si, 0.1% by mass or more and 0.6% by mass or less of Mn, 10% by mass or more and 30% by mass or less of Cr, 0.1% by mass or more and 6% by mass or less of Al, 0.01% by mass or more and 12% by mass or less of Fe, and 0.01% by mass or more and 0.6% by mass or less of Ti, with the balance being Ni and inevitable impurities.

The nickel alloy may further contain 0.01% by mass or more and 0.7% by mass or less, in total, of a rare earth element.

In the nickel alloy having the composition (2), in addition to Cr and Al, Si, Mn, Fe, and Ti are essential. This nickel alloy that forms the covering 12 contains an increased number of essential elements and contains respective elements in slightly larger amounts than those in the core wire 11. Therefore, the nickel alloy has good oxidation resistance.

The contents of the elements in the nickel alloy having the composition (2) can be as follows while anticipating, for example, a decrease in the specific resistance and improvements in the thermal conductivity and oxidation resistance.

Si: 0.15% by mass or more and 1.3% by mass or less, further, 0.2% by mass or more and 1.2% by mass or less, Mn: 0.2% by mass or more and 0.55% by mass or less, further, 0.3% by mass or more and 0.5% by mass or less, Fe: 0.02% by mass or more and 11.5% by mass or less, further, 0.03% by mass or more and 11% by mass or less Ti: 0.02% by mass or more and 0.55% by mass or less, further, 0.03% by mass or more and 0.5% by mass or less Rare earth element: 0.1% by mass or more and 0.65% by mass or less in total, further, 0.2% by mass or more and 0.6% by mass or less in total <Effect of Addition of Each Element>

Silicon (Si) is an element having a high antioxidant effect and enables oxidation resistance to be enhanced. Silicon generates an oxide film afterwards as described above and easily suppresses oxidation to the inside of the electrode. With an increase in the Si content, the antioxidant effect due to the formation of the oxide film is easily achieved. By setting the Si content to be equal to or less than the upper limit, an increase in the specific resistance and peeling, damage, or the like of the oxide film due to an increase in the thickness of the oxide film can be reduced.

Manganese (Mn) has the antioxidant effect, in particular, the effect of suppressing internal oxidation. When Mn is contained within the above range, oxidation resistance can be enhanced. With an increase in the Mn content, oxidation resistance is easily enhanced. By setting the Mn content to be equal to or less than the upper limit, an increase in the specific resistance can be reduced.

When Fe is contained, hot workability improves to provide good manufacturability. With an increase in the Fe content, hot workability is easily enhanced. By setting the Fe content to be equal to or less than the upper limit, an increase in the specific resistance can be reduced, and a decrease in strength of a spark plug at an operating temperature can be reduced.

Titanium (Ti) contained within the above range provides a crystal refinement effect. A fine crystal structure enables a total length of grain boundaries to be increased, easily suppresses internal oxidation, and easily enhances oxidation resistance. When the covering 12 is composed of a nickel alloy that contains Ti, the covering 12 easily has a fine crystal structure, and oxidation resistance is easily enhanced. In addition, since Ti suppresses the generation of a nitride of Al (AlN), oxidation resistance is easily enhanced. This is because damage of an oxide film due to the generation of a nitride of Al in the oxide film can be suppressed, and the oxide film is easily maintained. With an increase in the Ti content, oxidation resistance is easily enhanced. By setting the Ti content to be equal to or less than the upper limit, an increase in the specific resistance can be reduced.

A rare earth element contained within the above range provides a crystal refinement effect. As described above, internal oxidation is easily suppressed, and oxidation resistance is easily enhanced by reducing the grain size. When the covering 12 is composed of a nickel alloy that contains a rare earth element, the covering 12 easily has a fine crystal structure, and oxidation resistance is easily enhanced. With an increase in the content of the rare earth element, oxidation resistance is easily enhanced. When the content of the rare earth element is equal to or less than the upper limit, an increase in the specific resistance can be reduced, and a decrease in plastic workability is suppressed to achieve good manufacturability of the composite 10 and an electrode.

In addition to the above, the nickel base material that forms the core wire 11 and the nickel alloy that forms the covering 12 may contain carbon (C). The C content may be more than 0% by mass and 0.1% by mass or less. When C is contained within the above range, high-temperature strength can be enhanced while suppressing a decrease in plastic workability. With an increase in the C content, high-temperature strength can be further enhanced. With a decrease in the C content, plastic workability is improved, and manufacturability of the composite 10 and an electrode is also improved. The covering 12, for which high-temperature strength is required, can have a C content of 0.01% by mass or more and 0.09% by mass or less, further, 0.02% by mass or more and 0.08% by mass or less. When the nickel alloy that forms the covering 12 has a higher C content than the core wire 11, high-temperature strength is easily enhanced. The core wire 11 can have a C content of 0.001% by mass or more and 0.09% by mass or less, further, 0.005% by mass or more and 0.08% by mass or less.

(Structure)

The nickel base material that forms the core wire 11 and the nickel alloy that forms the covering 12 each typically have a crystal structure. Regarding the covering 12, which is arranged on the outside exposed to the external environment in a usage state of a spark plug electrode composed of the electrode material 1 according to the embodiment, with a decrease in the grain size, a total length of grain boundaries increases, it becomes difficult for oxygen to enter the inside, and thus oxidation resistance is easily enhanced. In contrast, regarding the core wire 11, which is arranged on the inside of the covering 12 in the usage state described above, with an increase in the grain size, the electrical conductivity becomes better to easily decrease the specific resistance, the thermal conductivity also becomes better to provide better heat dissipation ability, and heat is unlikely to be accumulated in the inside. In such an embodiment of the electrode material 1, a ratio (core wire/covering) of a grain size of the nickel base material that forms the core wire 11 to a grain size of the nickel alloy that forms the covering 12 is 5 or more. When the ratio (core wire/covering) of the grain size is 5 or more, the nickel base material that forms the core wire 11 has a relatively large grain size to easily decrease the specific resistance, and in addition, the nickel alloy that forms the covering 12 has a relatively small grain size to provide good oxidation resistance. With an increase in the ratio (core wire/covering) of the grain size, for example, when the ratio is more than 5, further, 6 or more, 7 or more, and 8 or more, the specific resistance is more easily decreased, and oxidation resistance is more easily enhanced. An electrode material 1 having higher sparking wear resistance and higher oxidation resistance can be obtained by adjusting not only the compositions but also the structures of the core wire 11 and the covering 12.

The grain size of the nickel base material that forms the core wire 11 is, for example, about 50 μm or more and about 500 μm or less, further, about 100 μm or more and about 400 μm or less. The grain size of the nickel alloy that forms the covering 12 is, for example, about 10 μm or more and about 100 μm or less, and about 20 μm or more and about 60 μm or less.

Examples of a method for adjusting the crystal grain size include adjusting the compositions described above and adjusting heat treatment conditions in the manufacturing process. For example, incorporation of an element (such as Ti or a rare earth element) having the crystal refinement effect easily reduces the crystal grain size, although it depends on the manufacturing conditions. Alternatively, for example, in the case where heat treatment is performed in the manufacturing process, the crystal grain size is easily reduced by setting the heat treatment temperature to be slightly low, although it depends on the compositions.

(State of Interface)

The inventors of the present invention have found that adhesion is further enhanced when a diffusion layer 13 in which the Ni content changes in a gradient manner is included between the core wire 11 and the covering 12. Typically, the diffusion layer 13 is a region where the Ni content decreases from the core wire 11 toward the covering 12 compared with the nickel base material that forms the core wire 11, the region being a region where the Ni content increases from the covering 12 toward the core wire 11 compared with the nickel alloy that forms the covering 12. The region where the Ni concentration changes in a gradient manner is generated by diffusion of components that constitute the core wire 11 and the covering 12 near an interface between the core wire 11 and the covering 12. Herein, this region is referred to as a diffusion layer 13.

The diffusion layer 13 has a composition that is different from the composition of the nickel base material that forms the core wire 11 and different from the composition of the nickel alloy that forms the covering 12. Therefore, the diffusion layer 13 may be determined by analyzing the components of the composite 10 by an appropriate method, comparing the composition near the interface described above, the composition at a central portion of the core wire 11, and the composition on the surface side of the covering 12, and extracting the diffusion layer as a region having a different Ni content. The "composition at a central portion of the core wire 11" may be a composition at the center of gravity in the outline shape of the core wire 11. For example, when the outline of the core wire 11 is rectangular as illustrated in FIG. 1, the composition near the intersection point of diagonal lines of the rectangle may be defined as the "composition at a central portion of the core wire 11". The composition on the surface side of the covering 12 may be, for example, a composition at a position located from the outermost surface of the covering 12 to about 20% of the thickness of the covering 12. An example of a simple method for extracting the diffusion layer 13 is as follows. A cross section of the composite 10 is prepared, and a region near the interface between the core wire 11 and the covering 12 is observed with a microscope. The colors of the diffusion layer 13, the core wire 11, and the covering 12 appear different from each other due to the difference in composition. A region having a different color and located between the core wire 11 and the covering 12 is extracted as the diffusion layer 13.

The diffusion layer 13 is typically present along the interface between the core wire 11 and the covering 12 so as to have a tubular shape. When the diffusion layer 13 has an average thickness $t_{13}$ of more than 1 adhesion is enhanced. When the average thickness $t_{13}$ is 1.2 μm or more, further, 1.5 μm or more, adhesion is further enhanced. When the average thickness $t_{13}$ is about 10 μm or less, further, about 8 μm or less, a decrease in the core wire 11 and the covering 12 due to the formation of the diffusion layer 13 can be reduced. The average thickness $t_{13}$ may be determined by extracting the diffusion layer 13 on a cross section of the composite 10, determining five or more measurement points on the diffusion layer 13 at equal intervals along the circumferential direction of the core wire 11, and averaging the thicknesses at these measurement points.

In order to form the diffusion layer 13, for example, process conditions, heat treatment conditions, and the like may be adjusted in the manufacturing process. Details of the manufacturing conditions will be described later.

(Specific Resistance)

In the electrode material 1 according to the embodiment, the composite 10 has a specific resistance of less than 50 μΩ·cm at room temperature (typically about 20° C.). With a decrease in the specific resistance of the composite 10, namely, 48 μΩ·cm or less, further, 46 μΩ·cm or less, in particular, 30 μΩ·cm or less, 25 μΩ·cm or less, 20 μΩ·cm or less, and 15 μΩ·cm or less, higher sparking wear resistance is provided.

Although the composite 10 includes the covering 12, which has a slightly high specific resistance, the composite 10 has a low specific resistance as a whole, as described above, because the composite 10 also includes the core wire 11, which has a slightly low specific resistance. The specific resistance of the composite 10 is changed by the composition of the core wire 11, the composition of the covering 12, the ratio (core wire/covering) of the grain size, a covering ratio described below, and the like. In the electrode material 1 according to the embodiment, the compositions, the ratio, the covering ratio, and the like are adjusted such that the specific resistance of the composite 10 satisfies less than 50 μΩ·cm. The specific resistance is easily reduced by, for example, using a nickel base material having a higher Ni content as the core wire 11, increasing the ratio (core wire/covering) to a certain extent, or further decreasing the covering ratio.

(Covering Ratio)

A ratio of the covering 12 to the core wire 11 in the composite 10 can be adjusted within a range in which the specific resistance of the composite 10 satisfies less than 50 μΩ·cm as described above. In an embodiment of the electrode material 1, an area ratio (covering ratio) of a cross sectional area of the covering 12 to a cross sectional area of the composite 10 in a cross section of the composite 10 is 0.4 or more and 0.7 or less. At a covering ratio of 0.4 or more, a decrease in oxidation resistance due to an excessively high ratio of the core wire 11 can be suppressed, and oxidation resistance is easily enhanced. With an increase in the ratio of the covering 12, namely, at a covering ratio of 0.45 or more, further, 0.5 or more, the oxidation resistance is further enhanced. At a covering ratio of 0.7 or less, an increase in the specific resistance due to an excessively high ratio of the covering 12 can be suppressed, and the specific resistance is easily decreased. With a decrease in the ratio of the covering 12, namely, at a covering ratio of 0.65 or less, further, 0.6 or less, the specific resistance is more easily decreased.

In the manufacturing process, a ratio of the thickness of the material that finally functions as the covering 12 to the thickness of the material that finally functions as the core wire 11 may be adjusted or process conditions may be adjusted such that the covering ratio is within the predetermined range. Note that the covering ratio is selected depending on the compositions of the materials within a range in which the specific resistance of the composite 10 satisfies less than 50 μΩ·cm.

(Shape and Size)

Examples of the electrode material 1 according to an embodiment include a square wire (FIG. 1) having a rectangular cross-sectional shape and a round wire having a circular cross sectional shape. The outer shape of the electrode material 1 (which is the outer shape of the composite 10 and is also the outer shape of the covering 12) can be appropriately changed by subjecting the electrode material 1 to plastic working such as wire drawing and rolling in the manufacturing process. When the covering 12 has a tubular shape having a uniform thickness in the circumferential direction thereof, the core wire 11 has a cross-sectional shape similar to the outer shape of the electrode material 1.

The size (such as the cross sectional area or the wire diameter) of the electrode material 1 can be appropriately selected. When the electrode material 1 is a square wire, the electrode material 1 may have a thickness t of about 1 mm or more and about 3 mm or less and a width w of about 2 mm or more and about 4 mm or less. When the electrode material 1 is a round wire, the electrode material 1 may have a wire diameter of about 2 mm or more and about 6 mm or less. The size (the same as the above) of the core wire 11 and the thickness of the covering 12 can be within ranges corresponding to the covering ratio described above.

Figure 2:
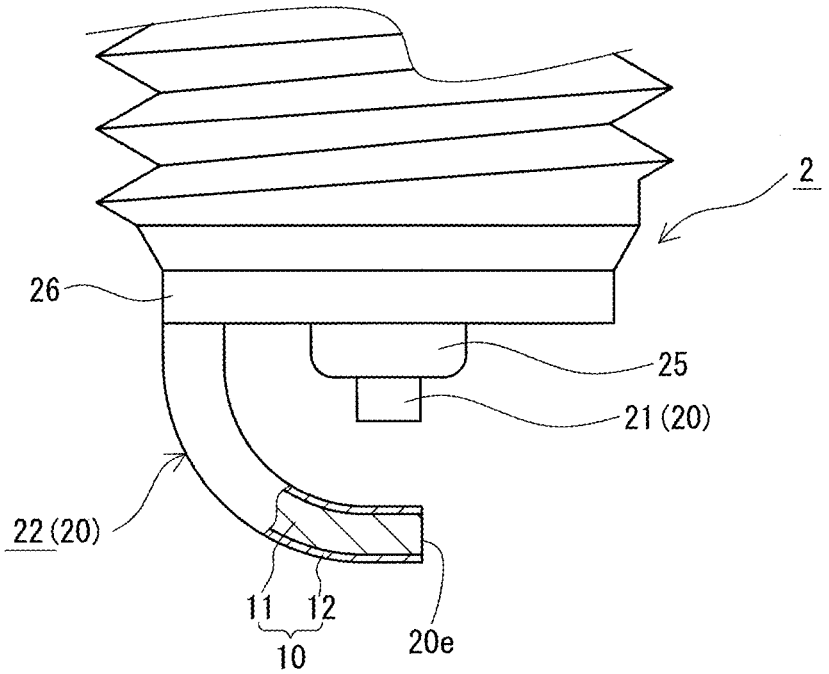
FIG. 2 is a schematic view illustrating a spark plug that includes a spark plug electrode composed of an electrode material according to an embodiment and illustrates a portion near the electrode.

In the electrode material 1 according to the embodiment, the core wire 11 is exposed at an end face of the electrode material 1. As illustrated in FIG. 2, an electrode 20 in which a core wire 11 is exposed from an end face 20*e* can be formed by using such an electrode material 1.

(Method for Manufacturing Electrode Material)

For example, the following fitting method can be used for manufacturing the electrode material 1 according to an embodiment. The fitting method as used herein refers to a method including preparing a raw material wire that finally functions as the core wire 11, and performing plastic working such as wire drawing and rolling in a state where a covering raw material that finally functions as the covering 12 is fitted on the raw material wire. An example of the fitting method includes a preparation step, a fitting step, and a working step described below. The method that further includes a heat treatment step of performing heat treatment after the working step enables the manufacture of a composite 10 that includes the diffusion layer 13 described above.

(Preparation Step) A step of arranging a covering raw material around a raw material wire to produce a preparatory material in which an outer periphery of the raw material wire is covered with the covering raw material.

(Fitting Step) A step of subjecting the preparatory material to plastic working to fasten the preparatory material, thereby producing a fitted material in which the covering raw material is fitted on an outer periphery of the raw material wire.

(Working step) A step of subjecting the fitted material to plastic working so as to have a predetermined size and a predetermined shape, thereby producing a worked material that includes a core wire 11 and a covering 12 disposed on the outer periphery of the core wire 11.

Hereafter, each of the steps will be described.

<Preparation Step>

In this step, a raw material wire and a covering raw material having predetermined compositions, which have been described in the sections of the compositions of the core wire 11 and the covering 12, are prepared. Materials having various forms such as a tape, a sheet, a wire rod, and a pipe can be used as the covering raw material. Wire rods that form the raw material wire and the covering raw material may be manufactured through the steps of, for example, melting→casting→hot working (such as rolling, forging, and extrusion)→cold working (such as wire drawing and rolling) and then optionally heat treatment. For the manufacture of the raw material wire and the covering raw material, a known method for manufacturing a metal wire, a metal plate, a metal sheet, or a metal pipe can be referred to.

Examples of the method for arranging a covering raw material on the outer periphery of a raw material wire include the following methods.

(a) A tape, a sheet, or a wire rod that forms the covering raw material is wound around the raw material wire.

(b) The raw material wire is inserted into and arranged in a pipe that forms the covering raw material.

(c) Wire rods that form the covering raw material are arranged around the raw material wire along the axial direction so as to extend longitudinally.

After the covering raw material is arranged on the outer periphery of the raw material wire, if necessary, a plurality of wire rods, edges of a sheet, or the like forming the covering raw material, or the raw material wire and the covering raw materials or the like may be joined to each other by a joining method such as welding or brazing. In this case, misalignment between the raw material wire and the covering raw material is unlikely to occur, and the subsequent fitting step is easily performed.

In manufacturing the raw material wire and the covering raw material, for example, the atmosphere during melting and during casting may be a low-oxygen atmosphere having a lower oxygen concentration than air atmosphere (for example, having an oxygen concentration of 10% by volume or less). In such a case, oxidation of a raw material, in particular, such as a rare earth element, is easily suppressed.

In addition, the outer shape of the drawn wire rod can be changed from, for example, a round wire to a square wire or the like by performing, as cold working, rolling after wire drawing.

When heat treatment is performed after the cold working, workability of the resulting heat-treated material is enhanced, and thus plastic working is easily performed in the subsequent working step. For conditions for this heat treatment, known conditions (for example, Patent Literature 1) can be referred to.

Furthermore, the shapes and the sizes (such as outer dimensions and thicknesses) of the raw material wire and the covering raw material may be selected in accordance with the cross sectional shape of a composite 10, the degree of working and the worked state in the subsequent working step, and the like so as to obtain a composite 10 that satisfies a final shape, final outer dimensions, and a predetermined covering ratio.

<Fitting Step>

In the fitting step, the preparatory material, in particular, the covering raw material, is fastened from the outside of the preparatory material so as to integrate the raw material wire and the covering raw material, thereby producing a fitted material. Plastic working such as wire drawing and rolling can be used for the fastening. Here, the plastic working may be working in which the covering raw material is fastened to such an extent that the covering raw material can be brought into close contact with the raw material wire. For example, the plastic working may be working in which the degree of working (reduction rate of area) per working is relatively high, specifically, working in which the reduction rate of area is more than 20%.

<Working Step>

In the working step, the integrated fitted material is subjected to plastic working such as wire drawing and rolling such that the raw material wire and the covering raw material are respectively formed into a core wire 11 and a covering 12 that have predetermined shapes and predetermined sizes. This plastic working can be cold working. In the working step, working can be repeatedly performed until the final shape and the final dimensions are obtained. In this case, the method may optionally include an intermediate heat treatment step in which heat treatment is performed between working and working. The object to be worked is softened by the intermediate heat treatment, and the subsequent working can be easily performed.

<Heat Treatment Step>

In this step, the worked material produced in the working step is subjected to heat treatment to form the above-described diffusion layer 13 near the interface between the core wire 11 and the covering 12. The formation of the diffusion layer 13 further enhances adhesion between the core wire 11 and the covering 12 as described above. The heat treatment conditions depend on the composition of the core wire 11, the composition of the covering 12, the degree of working, and the like. However, the heating temperature may be about 150° C. or higher and about 1,200° C. or lower, and the heating time may be about 1 second or more and about 20 hours or less. Although the heat treatment conditions depend on the compositions of the core wire 11 and the covering 12, the degree of working, and the like, in the case where the heating temperature is a relatively low temperature, for example, about 150° C., the heating time can be made slightly long within the above range, and in the case where the heating temperature is a relatively high temperature, for example, about 1,200° C., the heating time can be made slightly short within the above range. The diffusion layer 13 having an average thickness of more than 1 μm is easily formed under the conditions in which the degree of working is increased to a certain extent and the heating temperature is set to a slightly low temperature within the above range, or the conditions in which the degree of working is decreased to a certain extent and the heating temperature is set to a slightly high temperature within the above range, although the conditions depend on the compositions of the core wire 11 and the covering 12, the degree of working, and the like. In addition, it is also expected that the heat treatment can provide an effect of decreasing the specific resistance of the composite 10 (improvement in the sparking wear resistance) by removing work strain introduced in the working step and an effect of easily working the material into an electrode 20 having a predetermined shape (improvement in workability). Furthermore, the size of the crystal grains can be adjusted to a certain extent by the heat treatment conditions described above. When the heating temperature is set to a slightly low temperature, the grain size tends to easily decrease, although it depends on the compositions, the degree of working, and the like. In the case where the composite 10 includes the core wire 11 having the composition (1) and the covering 12 having the composition (2), and in the case where a rare earth element is further contained in the composition (1) and the composition (2) within the ranges described above, the heating temperature may be 800° C. or higher, further, 850° C. or higher and 1,200° C. or lower (refer to Test Example 1).

(Use)

The electrode material 1 according to the embodiment can be used as a material of an electrode included in a spark plug 2 used in an engine of, for example, an automobile such as a four-wheeled vehicle or a motorcycle.

(Main Advantages)

The electrode material 1 according to the embodiment has a low specific resistance and good sparking wear resistance due to the presence of the core wire 11 composed of a nickel based material that has a high Ni content and also has good oxidation resistance due to the presence of the covering 12 composed of a nickel alloy that contains Cr and Al in specific ranges. The outer peripheral surface of the core wire 11 is covered with the covering 12 so that, in the core wire 11, only an end face is substantially a region exposed to the external environment, and thus the electrode material 1 has a structure in which oxidation of the core wire 11 is easily suppressed. This also provides good oxidation resistance to the electrode material 1 according to the embodiment. Since the core wire 11 and the covering 12 contain the main component (Ni) in common, the core wire 11 and the covering 12 can adhere to each other, and oxidation is unlikely to proceed from an end face of the electrode material 1 to the inside of the electrode material 1 along the interface between the core wire 11 and the covering 12. This also provides good oxidation resistance to the electrode material 1 according to the embodiment. These advantages will be specifically described in Test Example 1 below.

Furthermore, the electrode material 1 according to the embodiment includes the core wire 11 having a high Ni content and having a good thermal conductivity, exposes the core wire 11 at an end face of the electrode material 1 to uniformly conduct heat over the entire length of the electrode material 1, and has good heat dissipation ability. Therefore, heat is unlikely to be accumulated inside the electrode material 1, and, for example, a decrease in high-temperature strength can also be reduced.

[Spark Plug Electrode]

An electrode 20 according to an embodiment is used in a spark plug 2 as illustrated in FIG. 2 and is composed of the electrode material 1 according to the embodiment described above. Since the electrode 20 substantially maintains, for example, the composition, the structure, and characteristics such as the specific resistance of the electrode material 1, the electrode 20 has a low specific resistance of less than 50 μΩ·cm, good sparking wear resistance, and good oxidation resistance.

In the electrode 20 according to the embodiment, both a core wire 11 and a covering 12 are typically exposed at an end face 20*e*. Since the electrode 20 is composed of the electrode material 1 according to the embodiment, the electrode material 1 including the specific composite 10 described above, the electrode 20 has good oxidation resistance and good corrosion resistance, although the core wire 11 is exposed at the end face 20*e*. This is because since adhesion between the core wire 11 and the covering 12 is good as described above, it is easy to suppress the progress of oxidation and corrosion from the end face 20*e* of the electrode 20 to the inside of the electrode 20 along the interface between the core wire 11 and the covering 12. In the case where the electrode 20 includes the diffusion layer 13, the progress of oxidation and corrosion is further suppressed. In addition, since the core wire 11 is exposed at the end face 20*e* of the electrode 20, heat can be uniformly conducted from the end face 20*e* of the electrode 20 over the entire length of the electrode 20, and the electrode 20 also has good heat dissipation ability. Here, the core wire 11 has a high Ni content as described above. Therefore, when the core wire 11 is excessively maintained at a high temperature, the core wire 11 may be softened and deformed, for example, bent. Since the electrode 20 has good heat dissipation ability, and heat is unlikely to be accumulated, the softening and the deformation can be prevented. The electrode 20 includes the covering 12 having good high-temperature strength. Therefore, even if the core wire 11 is softened, the covering 12 can prevent the electrode 20 from deforming.

The electrode 20 according to the embodiment can be manufactured by cutting the electrode material 1 according to the embodiment to have an appropriate length and forming the cut wire rod into a predetermined shape. The electrode 20 according to the embodiment, the electrode 20 being composed of the electrode material 1 according to the embodiment, can be used as a center electrode 21 or a ground electrode 22, or both. FIG. 2 illustrates an example of the ground electrode 22 composed of the electrode material 1 according to the embodiment. The ground electrode 22 is likely to be exposed to, for example, a gas at a high temperature compared with the center electrode 21. Therefore, the electrode material 1 according to the embodiment is suitable for the material of the ground electrode 22.

[Spark Plug]

A spark plug 2 according to an embodiment is included in an engine of an automobile or the like and used for, for example, ignition of a fuel mixed gas, and includes an electrode 20 according to an embodiment. The spark plug 2 typically includes a bar-shaped center electrode 21, an insulator 25 that holds the center electrode 21 in a state where a frond end of the center electrode 21 is projected, a metal shell 26 that holds the insulator 25 in a state where a front end of the insulator 25 is projected, and an L-shaped ground electrode 22 that is joined to an end face of the metal shell 26 by welding or the like. One end of the ground electrode 22 is joined to the metal shell 26, and a region of the other end of the ground electrode 22 is bent so as to face an end face of the center electrode 21. A spark discharge is generated between the ground electrode 22 and the center electrode 21. The ignition is performed by this discharge.

Since the spark plug 2 according to the embodiment include the electrode 20 composed of the electrode material 1 according to the embodiment described above, the spark plug 2 has both good sparking wear resistance and good oxidation resistance. Furthermore, the spark plug 2 has good corrosion resistance and good heat dissipation ability as described above.

Test Example 1

Electrode materials having various compositions and structures were produced, and characteristics of the electrode materials were evaluated.

Sample Nos. 1-1 to 1-18 are wire rods each formed of a two-layer structured composite including a core wire and a covering that covers an outer peripheral surface of the core wire. Each of the wire rods is manufactured by the fitting method described above. In summary, a raw material wire that finally functions as the core wire and a covering raw material that finally functions as the covering are prepared, the covering raw material is fitted on the outer periphery of the raw material wire, and cold working (here, wire drawing and rolling) is subsequently performed. After this cold working, heat treatment is performed.

Sample Nos. 1-101 and 1-102 are each a single wire composed of a nickel alloy having the composition shown in Table 1 and are not formed of a two-layer structured composite.

Each of the raw material wire, the covering raw material, and the single wire described above is manufactured through the steps of melting→casting→hot working→cold working and then optionally heat treatment.

Here, molten metals of the nickel alloys (coverings or single wires) having the compositions shown in Table 1 and molten metals of the nickel base materials (core wires) having the compositions shown in Table 2 are produced by using a typical vacuum melting furnace. Commercially available granules of pure Ni and respective additive elements can be used as the raw materials of the molten metals. The molten metals are refined to reduce or remove impurities and inclusion. Here, the degree of refining is adjusted such that the C (carbon) content becomes the amount shown in Table 1 or Table 2.

The compositions are represented in units of % by mass.

In the tables, "BAL." denotes the balance and is Ni and inevitable impurities here.

In the tables "rare earth" denotes a rare earth element. Compositions containing Y alone or Y and Yb are shown here.

TABLE 1

| Sample | Composition (% by mass) Covering | | | | | | | | |
|---|---|---|---|---|---|---|---|---|---|
| No. | C | Si | Mn | Cr | Al | Fe | Ti | Rare earth | Ni |
| 1-1 | 0.04 | 0.2 | 0.3 | 14 | 0.3 | 6 | 0.25 | — | BAL. |
| 1-2 | 0.04 | 0.2 | 0.3 | 14 | 0.3 | 6 | 0.25 | — | BAL. |
| 1-3 | 0.04 | 0.2 | 0.3 | 14 | 0.3 | 6 | 0.25 | — | BAL. |
| 1-4 | 0.04 | 0.2 | 0.3 | 26 | 1.7 | 10 | 0.5 | — | BAL. |
| 1-5 | 0.04 | 0.2 | 0.3 | 26 | 1.7 | 10 | 0.5 | — | BAL. |
| 1-6 | 0.03 | 0.98 | 0.46 | 27 | 1 | 0.04 | 0.05 | Y0.3 | BAL. |
| 1-7 | 0.03 | 0.98 | 0.46 | 27 | 1 | 0.04 | 0.05 | — | BAL. |
| 1-8 | 0.04 | 0.2 | 0.3 | 17 | 5 | 10 | 0.2 | — | BAL. |
| 1-9 | 0.04 | 0.2 | 0.3 | 17 | 5 | 10 | 0.2 | — | BAL. |
| 1-10 | 0.04 | 0.2 | 0.3 | 14 | 0.3 | 6 | 0.25 | — | BAL. |
| 1-11 | 0.04 | 0.2 | 0.3 | 14 | 0.3 | 6 | 0.25 | — | BAL. |
| 1-12 | 0.04 | 0.2 | 0.3 | 14 | 0.3 | 6 | 0.25 | — | BAL. |
| 1-13 | 0.04 | 0.2 | 0.3 | 26 | 1.7 | 10 | 0.5 | — | BAL. |
| 1-14 | 0.04 | 0.2 | 0.3 | 26 | 1.7 | 10 | 0.5 | — | BAL. |
| 1-15 | 0.03 | 0.98 | 0.46 | 27 | 1 | 0.04 | 0.05 | Y0.3 | BAL. |
| 1-16 | 0.03 | 0.93 | 0.46 | 27 | 1 | 0.04 | 0.05 | Y0.5 | BAL. |
| 1-17 | 0.04 | 0.2 | 0.3 | 17 | 5 | 10 | 0.2 | — | BAL. |
| 1-18 | 0.04 | 0.2 | 0.3 | 17 | 5 | 10 | 0.2 | — | BAL. |
| 1-101 | 0.02 | 1 | 1 | 0.2 | 0.05 | 0.1 | 0.05 | | BAL. |
| 1-102 | 0.04 | 0.2 | 0.3 | 15 | 0.25 | 8 | 0.25 | — | BAL. |

TABLE 2

| Sample | Composition (% by mass) Core wire | | | | | | | | | Composite Cross sectional area ratio | |
|---|---|---|---|---|---|---|---|---|---|---|---|
| No. | C | Si | Mn | Cr | Al | Fe | Ti | Rare earth | Ni | Covering | Core wire |
| 1-1 | 0.008 | 0.06 | 0.5 | 0.001 | 0.001 | 0.4 | 0 | — | BAL. | 0.4 | 0.6 |
| 1-2 | 0.02 | 1 | 1 | 0.1 | 0.05 | 0.1 | 0.05 | Y0.5 | BAL. | 0.4 | 0.6 |
| 1-3 | 0.01 | 0.8 | 0.2 | 0.2 | 0.001 | 0.04 | 0.1 | Y0.2, Yb0.25 | BAL. | 0.4 | 0.6 |
| 1-4 | 0.008 | 0.06 | 0.5 | 0.001 | 0.001 | 0.4 | 0 | — | BAL. | 0.4 | 0.6 |
| 1-5 | 0.01 | 0.5 | 0.2 | 0.5 | 0.001 | 0.04 | 0.1 | Y0.3 | BAL. | 0.4 | 0.6 |
| 1-6 | 0.008 | 0.06 | 0.05 | 0.001 | 0.001 | 0.4 | 0 | — | BAL. | 0.4 | 0.6 |
| 1-7 | 0.02 | 1 | 1 | 0.1 | 0.05 | 1 | 0.05 | Y0.1 | BAL. | 0.4 | 0.6 |
| 1-8 | 0.07 | 0.08 | 0.2 | 0.001 | 0.001 | 0.05 | 0 | — | BAL. | 0.4 | 0.6 |
| 1-9 | 0.01 | 0.3 | 0 | 1.2 | 0.2 | 0.04 | 0.25 | Y0.2 | BAL. | 0.4 | 0.6 |
| 1-10 | 0.008 | 0.06 | 0.5 | 0.001 | 0.001 | 0.4 | 0 | — | BAL. | 0.7 | 0.3 |
| 1-11 | 0.02 | 1 | 1 | 0.1 | 0.2 | 1 | 0.05 | Y0.5 | BAL. | 0.7 | 0.3 |
| 1-12 | 0.01 | 0.5 | 0.2 | 0.2 | 0.001 | 0.04 | 0.1 | Y0.4, Yb0.25 | BAL. | 0.7 | 0.3 |
| 1-13 | 0.008 | 0.06 | 0.5 | 0.001 | 0.001 | 0.4 | 0 | — | BAL. | 0.7 | 0.3 |
| 1-14 | 0.01 | 0.04 | 0.2 | 0.6 | 0.05 | 0.04 | 0.1 | Y0.3 | BAL. | 0.7 | 0.3 |
| 1-15 | 0.008 | 0.06 | 0.5 | 0.001 | 0.001 | 0.4 | 0 | — | BAL. | 0.7 | 0.3 |
| 1-16 | 0.02 | 1 | 1 | 0.1 | 0.04 | 0.1 | 0.05 | Y0.5 | BAL. | 0.7 | 0.3 |
| 1-17 | 0.07 | 0.08 | 0.2 | 0.001 | 0.001 | 0.05 | 0 | — | BAL. | 0.7 | 0.3 |
| 1-18 | 0.01 | 0.3 | 0 | 1.2 | 0.2 | 0.04 | 0.25 | Y0.2 | BAL. | 0.7 | 0.3 |
| 1-101 | No core wire | | | | | | | | | 1 | 0 |
| 1-102 | No core wire | | | | | | | | | 1 | 0 |

The covering raw material is arranged around the resulting raw material wire, and plastic working is performed to fasten the covering raw material and the raw material wire, thereby producing an integrated fitted material, and the fitted material is subjected to cold working. As the cold working, after cold wire drawing, cold rolling is performed here. The degree of working of the cold wire drawing is selected such that a two-layer structured drawn wire rod obtained after cold wire drawing becomes a round wire having an outer diameter of 1 mmϕ to 3 mmϕ. The degree of working of the cold rolling is selected such that the round wire becomes a square wire having outer dimensions of a width of 0.5 mm or more and 2.0 mm or less and a length of 1.5 mm or more and 3.0 mm or less. The sizes of the raw material wire and the covering raw material to be produced, the degrees of working, etc. are adjusted such that, regarding the two-layer structured composite that is finally produced and that includes a core wire and a covering, the area ratio of a cross sectional area of the covering and the area ratio of a cross sectional area of the core wire to a cross sectional area of the composite in a cross section thereof become the cross sectional area ratio shown in Table 2.

The square wire is subjected to final heat treatment, and the resulting heat-treated material is used as a sample of an electrode material. In the final heat treatment of sample Nos. 1-1 to 1-18 and 1-111 in Table 3, the heating temperature is selected from a range of 800° C. or higher and 1,200° C. or lower, and the retention time is selected from a range of one second or more and two hours or less. The atmosphere is a nitrogen atmosphere or a hydrogen atmosphere.

In Table 3, sample Nos. 1-1, 1-111, and 1-112 are samples in which raw material wires and covering raw materials having the same composition and the same size are used, and only the conditions for the final heat treatment are changed. Sample Nos. 1-2 and 1-6 are samples in which the conditions for the final heat treatment are different from the conditions of sample No. 1-1. Here, the retention time is the same, and the heating temperature is changed. More specifically, the heating temperature of sample No. 1-1 is assumed to be a standard, the heating temperature of sample No. 1-111 is the lowest (lower than 850° C. here), the heating temperature of sample No. 1-6 is decreased to a certain degree (850° C. or higher here), and the heating temperature of sample No. 1-2 is increased to a certain degree. The heating temperature of No. 1-112 is the highest and is out of the range of the heating temperature described above (higher than 1,200° C. and 1,300° C. or lower). Sample No. 1-4 is a sample in which the conditions for the final heat treatment are the same as the conditions of sample No. 1-1.

<Composition>

The compositions of the electrode materials of the samples are examined by using an inductively coupled plasma (ICP) atomic emission spectrometer. According to the results, the compositions are the same as the compositions shown in Tables 1 and 2, and the electrode materials contain the elements shown in Tables 1 and 2, with the balance consisting of Ni and inevitable impurities. In each of the electrode materials of sample Nos. 1-1 to 1-18, 1-111, and 1-112, the core wire has a Ni content of 96% by mass or more. In Tables 1 and 2, "- (hyphen)" or "0" indicates that the content is less than the detection limit and the element is not substantially contained. For the composition analysis, for example, atomic absorption spectrophotometry can be used.

<Structure>

Regarding the electrode material of each of the samples, the ratio (core wire/covering) of a grain size of the nickel base material that forms the core wire to a grain size of the nickel alloy that forms the covering is examined. Table 3 shows the results. Here, a cross section of the sample is observed with an optical microscope. For the resulting microscopic observation image, an average grain size of the core wire and an average grain size of the covering are determined by using an intersection line method (line method). Here, the observation magnification and the like are adjusted such that the number of crystal grains cut by one measurement line is 10 or more. Regarding each of the core wire and the covering, five or more measurement lines are prepared on one cross section, a total of 50 or more crystal grains are extracted, and the average of the grain sizes is determined. As the ratio (core wire/covering) of the grain size, the average grain size of the core wire/the average grain size of the covering is determined. Table 3 shows the measurement results of some of the samples.

When an electrode material has a ratio (core wire/covering) of less than 5, the ratio is small, both the core wire and the covering are considered to have a coarse crystal structure and the like, and the electrode material is rated as B. When an electrode material has a ratio (core wire/covering) of 5 or more and less than 10, the ratio is large, it is considered that the core wire has a relatively large crystal structure and the covering has a relatively fine crystal structure, and the electrode material is rated as G. When an electrode material has a ratio (core wire/covering) of 10 or more, the ratio is larger, it is considered that the core wire has a relatively larger crystal structure and the covering has a relatively finer crystal structure, and the electrode material is rated as VG. The evaluation results are also shown in Table 3. In this test, in each of the electrode materials of sample Nos. 1-1 to 1-18, the grain size of the core wire is about 50 μm or more and about 500 μm or less, and the grain size of the covering is about 10 μm or more and about 100 μm or less.

Regarding the electrode material of each of the samples, a cross section is prepared, and the cross section is observed with a scanning electron microscope (SEM) to examine an average thickness (μm) of a diffusion layer present between the core wire and the covering. Table 3 shows the results. Here, in the SEM observation image, a region where the color appears different from the colors of the core wire and the covering, the region being located between the core wire and the covering, is defined as the diffusion layer. In this SEM observation image, five or more measurement points are determined at equal intervals along the circumferential direction of the core wire, the thickness of the diffusion layer is determined at each of the measurement points, and the average of the these thicknesses is defined as the average thickness of the diffusion layer. Table 3 shows the measurement results of some of the samples.

Regarding the region where the color appears different, results of elemental analysis with, for example, an energy dispersive X-ray spectrometer (EDX) attached to a SEM show that the Ni content changes in a gradient manner from the core wire side toward the covering side. The extraction of the diffusion layer by elemental analysis enables the thickness of the diffusion layer to be measured with high accuracy. The use of the SEM observation image enables the thickness of the diffusion layer to be simply and easily measured.

<Specific Resistance>

The specific resistance (μΩ·cm) of the electrode material of each of the samples is measured. Table 3 shows the results. The specific resistance (at room temperature) is measured using an electric resistance measuring device by the direct-current four-terminal method. Here, the gauge length GL is 100 mm.

<Sparking Wear Resistance>

In the electrode materials of the samples, an electrode material having a specific resistance (at room temperature) of 50 μΩ·cm or more is considered to have poor sparking wear resistance and is rated as B. An electrode material having a specific resistance of less than 50 μΩ·cm is considered to have good sparking wear resistance and is rated as G. An electrode material having a specific resistance of less than 30 μΩ·cm is considered to have very good sparking wear resistance and is rated as VG. The evaluation results are also shown in Table 3.

<Oxidation Resistance>

The electrode material of each of the samples is subjected to the following thermal cycle test, and a change in the mass before and after the test is examined. Table 3 shows the results. Here, the change in the mass (%) is determined as $((W1-W0)/W0)\times 100$ where W0 represents a mass of a test piece before the thermal cycle test, and W1 represents a mass of the test piece after the thermal cycle test. When the sign of the change in the mass is minus (−), the result means that the mass is decreased after the test. When the sign of the change in the mass is plus (only the numerical value is described in Table 3), the result means that the mass is increased after the test.

<<Thermal Cycle Test>>

A thermal cycle in which heating is performed at 1,100° C. for 30 minutes and cooling is then performed at room temperature for 30 minutes is defined as one cycle, and this cycle is repeated 100 times.

When the change in the mass is a decrease (when the sign of the change is minus), it is considered that, for example, an oxide film is excessively formed and detached. Such an electrode material is considered to have poor oxidation resistance and is rated as B. When the change in the mass is an increase of more than 5% and 10% or less, it is considered that an oxide film is appropriately formed. Such an electrode material is considered to have good oxidation resistance and is rated as G. When the change in the mass is 0% or more and 5% or less, it is considered that an oxide film is more appropriately formed. Such an electrode material is considered to have very good oxidation resistance and is rated as VG. The evaluation results are also shown in Table 3.

<Adhesion>

Figure 3:
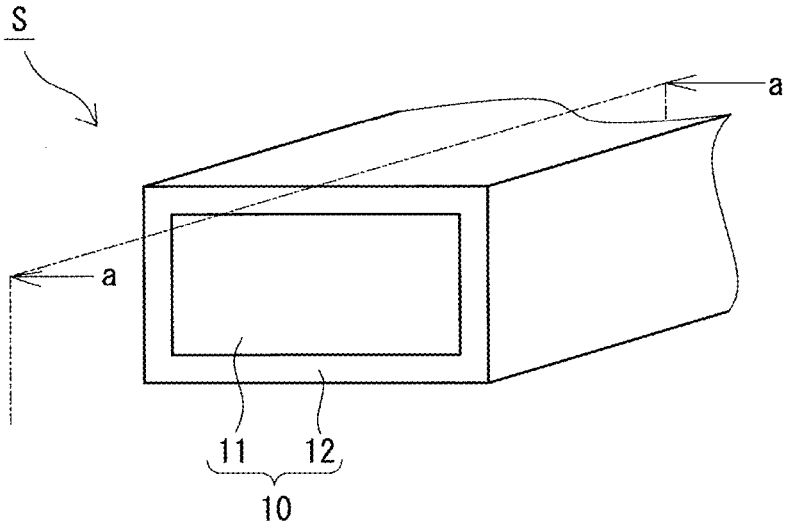
FIG. 3 is a view illustrating a test piece used to evaluate adhesion in Test Example 1.

The electrode material of each of the samples is subjected to the above thermal cycle test, and the degree of progress of oxidation along the interface between the core wire and the covering is examined. Table 3 shows the results. Here, as illustrated in FIG. 3, a square wire, which is an electrode material of each of the samples and in which a core wire 11 and a covering 12 are exposed at an end face of the square wire and an outer peripheral surface of the core wire 11 is covered with the covering 12, is prepared as a test piece S, and the thermal cycle test described above (100 cycles) is performed. Subsequently, a length of an oxide formed from the end face of the test piece S along the interface between the core wire 11 and the covering 12 is measured.

Figure 4:
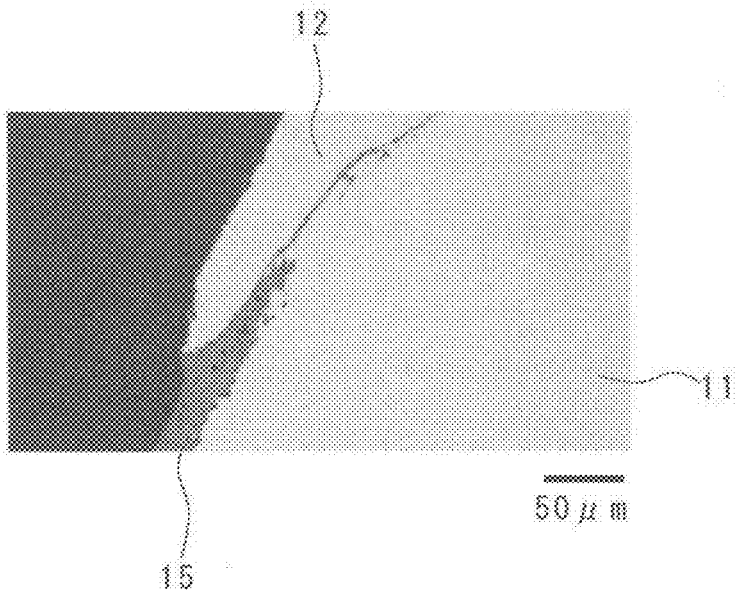
FIG. 4 is a micrograph of a section of a wire rod of sample No. 1-1 after a thermal cycle test for evaluating adhesion was performed in Test Example 1.
Figure 5:
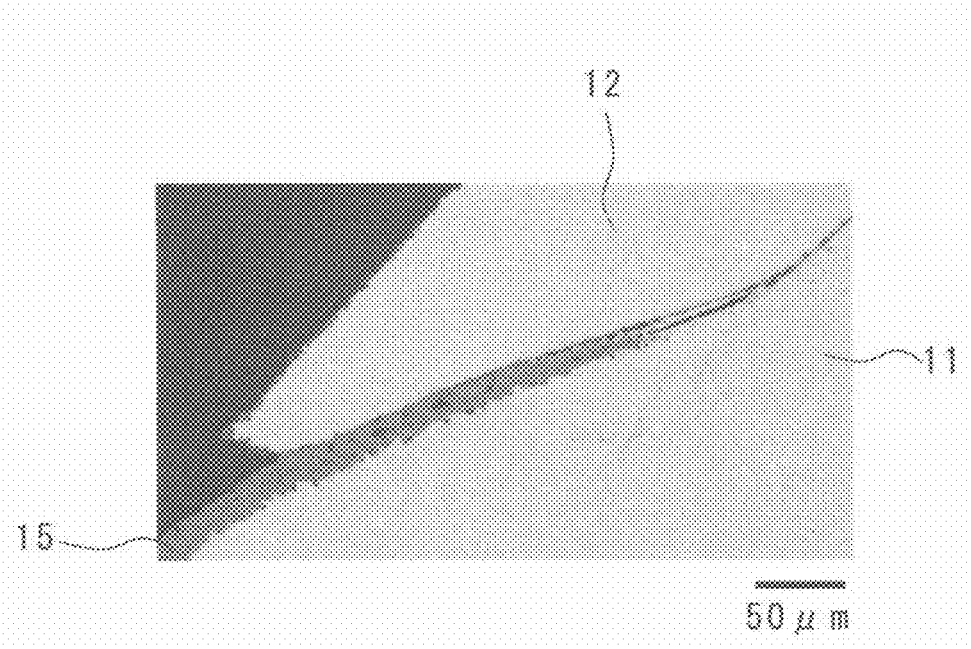
FIG. 5 is a micrograph of a section of a wire rod of sample No. 1-111 after a thermal cycle test for evaluating adhesion was performed in Test Example 1.

Here, after the thermal cycle test, a longitudinal section cut along a plane (refer to cutting-plane line a-a in FIG. 3) parallel to an axial direction of the core wire 11 is taken in the test piece S, and the longitudinal section is observed with a SEM. The length of an oxide along the interface (oxidation progress length, μm) is measured on this SEM observation image. The results are shown in Table 3. FIG. 4 shows a SEM observation image of sample No. 1-1. FIG. 5 shows a SEM observation image of sample No. 1-111. In the SEM observation images as shown in FIGS. 4 and 5, a region which is located between the core wire 11 and the covering 12 and in which the color appears different from the colors of the core wire 11 and the covering 12 is defined as an oxide 15. The inclusion mentioned above can be identified as an oxide by elemental analysis with, for example, the SEM-EDX spectrometer described above. The extraction of the oxide by elemental analysis enables the length of the oxide to be measured with higher accuracy. The use of the SEM observation image enables the length of the oxide to be measured simply and easily. An observation image obtained by a metallurgical microscope can be used for the measurement of the length of the oxide instead of the SEM observation image. The metallurgical microscope can also be used to confirm the difference in color between the core wire and the covering.

When the length of the oxide is 500 μm or more, it is considered that adhesion between the core wire and the covering is poor and a region near the interface is easily oxidized, and such an electrode material is rated as B. When the length of the oxide is less than 500 μM, it is considered that adhesion between the core wire and the covering is good, and such an electrode material is rated as G. When the length of the oxide is less than 100 μm, it is considered that adhesion between the core wire and the covering is very good, and such an electrode material is rated as VG. The evaluation results are also shown in Table 3.

<Overall Evaluation>

In the evaluations described above, when the results include at least one B, durability characteristics are considered to be poor, and such an electrode material is rated as B. When the results do not include B and include VG and G, durability characteristics are considered to be good, and such an electrode material is rated as G. When the results of all the items are VG, durability characteristics are considered to be very good, and such an electrode material is rated as VG. This overall evaluation is also shown in Table 3.

TABLE 3

| | Initial characteristics | | | | Durability characteristics | | | | | |
|---|---|---|---|---|---|---|---|---|---|---|
| | | Grain size | | Average | Oxidation | | Adhesion | | | |
| | Specific | Ratio | | thickness | resistance | | Oxidation | | Sparking | |
| Sample No.- | resistance (μΩ · cm) | core wire/ covering | Evaluation | of diffusion layer | Change in mass (%) | Evaluation | progress length (μm) | Evaluation | wear resistance | Overall evaluation |
| 1-1 | 12.7 | 10 | VG | 2 μm | 8 | G | 280 | G | VG | G |
| 1-2 | 28.4 | 5 | G | — | 5 | VG | 80 | VG | VG | G |

TABLE 3-continued

| | Initial characteristics | | | | Durability characteristics | | | | | |
|---|---|---|---|---|---|---|---|---|---|---|
| | | Grain size | | Average | Oxidation | | Adhesion | | | |
| | Specific | Ratio | | thickness | resistance | | Oxidation | | Sparking | |
| Sample No.- | resistance (μΩ · cm) | core wire/ covering | Evaluation | of diffusion layer | Change in mass (%) | Evaluation | progress length (μm) | Evaluation | wear resistance | Overall evaluation |
| 1-3 | 28.4 | — | — | — | 4 | VG | 70 | VG | VG | VG |
| 1-4 | 12.7 | 10 | VG | — | 8 | G | 280 | G | VG | G |
| 1-5 | 28.5 | — | | — | 4 | VG | 70 | VG | VG | VG |
| 1-6 | 12.7 | 20 | VG | — | 8 | G | 280 | G | VG | G |
| 1-7 | 28.5 | — | — | — | 5 | VG | 80 | VG | VG | VG |
| 1-8 | 14.2 | — | — | — | 8 | G | 280 | G | VG | G |
| 1-9 | 28.5 | — | — | — | 5 | VG | 80 | VG | VG | VG |
| 1-10 | 22.8 | — | — | — | 6 | G | 250 | G | VG | G |
| 1-11 | 45.1 | — | — | — | 3 | VG | 50 | VG | G | G |
| 1-12 | 45.1 | — | — | — | 2 | VG | 40 | VG | G | G |
| 1-13 | 22.9 | — | — | — | 6 | G | 250 | G | VG | G |
| 1-14 | 45.7 | — | — | — | 3 | VG | 50 | VG | G | G |
| 1-15 | 22.9 | — | — | — | 6 | G | 250 | G | VG | G |
| 1-16 | 45.7 | — | — | — | 3 | VG | 50 | VG | G | G |
| 1-17 | 25.3 | — | — | — | 6 | G | 250 | G | VG | G |
| 1-18 | 45.5 | — | — | — | 3 | VG | 50 | VG | G | G |
| 1-101 | 19.0 | — | — | — | −20 | B | — | — | VG | B |
| 1-102 | 110.0 | — | — | — | 0 | VG | — | — | B | B |
| 1-111 | 13.0 | 20 | VG | 1 μm | 8 | G | 500 | B | VG | B |
| 1-112 | 12.5 | 1 | B | 4 μm | 10 | G | 50 | VG | VG | B |

Table 3 shows that the electrode materials of sample Nos. 1-1 to 1-18 each formed of a composite that includes a core wire and a covering (hereinafter, may be referred to as a composite sample group) combine good sparking wear resistance and good oxidation resistance compared with sample Nos. 1-101 and 1-102 each formed of a single wire. Here, the composite sample group has good sparking wear resistance due to a low specific resistance and good oxidation resistance due to a small change (amount of increase) in the mass after the thermal cycle test.

One reason why the above results were obtained is considered to be as follows.

Sample No. 1-101 formed of a single wire having a high Ni content has a low specific resistance but has an extremely large change in the mass and has poor oxidation resistance. Sample No. 1-102 formed of a single wire composed of a nickel alloy that contains a slightly large amount of Cr has substantially no change in the mass and has good oxidation resistance but has an extremely high specific resistance. That is, it is difficult for a single wire to combine good sparking wear resistance and good oxidation resistance. In contrast, the composite sample group includes a composite that includes a core wire having a high Ni content and a covering composed of a nickel alloy that contains Cr and Al in specific ranges. Accordingly, it is considered that the specific resistance could be reduced by the core wire, and the oxidation resistance could be enhanced by the covering.

In the SEM observation image of sample No. 1-1 in FIG. 4, the gray region on the lower right side is the core wire 11, the central, strip-shaped gray region is the covering 12, the dark gray region is the oxide 15, and the black region on the left side is the background (the same applies to the SEM observation image of sample No. 1-111 in FIG. 5 described below). As show in FIG. 4, on the surface of the covering 12, a dark gray region having an extremely small thickness is merely present. This shows that the covering 12 is unlikely to oxidize and has good oxidation resistance. In contrast, in a part of the core wire 11, the part being exposed from the covering 12, a dark gray region that has a certain degree of thickness is present. This shows that oxidation easily occurs at a high Ni content.

In addition, the composite sample group includes the main component (Ni) of the core wire and the main component (Ni) of the covering in common and has good adhesion between the core wire and the covering. This is also considered to be the reason why the oxidation resistance could be enhanced. The adhesion will be described with reference to FIGS. 4 and 5. As shown in the SEM observation image in FIG. 4, in sample No. 1-1, although the oxide 15 is formed from the end face of the electrode material along the interface between the core wire 11 and the covering 12, the formation length of the oxide 15 from the end face is short, specifically, less than 300 μm. The short formation length of the oxide 15 is one basis for proving good adhesion between the core wire 11 and the covering 12. In contrast, as shown in the SEM observation image in FIG. 5, in sample No. 1-111, the formation length of the oxide 15 is long, specifically, 500 μm or more. This shows that, in sample No. 1-111, the core wire 11 and the covering 12 do not sufficiently adhere to each other, and oxygen and the like easily enter from the end face of the core wire 11 and the covering 12 through the interface. In such an electrode material, oxygen and the like enter from the interface between the core wire and the covering over time, an oxide is formed, and consequently, the core wire and the covering are separated from each other. Presumably, it is difficult to sufficiently achieve the effect due to the presence of the core wire and the covering. Accordingly, in order to satisfactorily achieve the effect of exhibiting both good sparking wear resistance and good oxidation resistance for a long time, it is preferable to improve the adhesion between the core wire and the covering.

Furthermore, this test shows the following.

(1) Even in the cases where the compositions of the coverings are the same, and the covering ratios are the same, sparking wear resistance and oxidation resistance can be changed by changing the compositions of the core wires (for example, refer to and compare among sample Nos. 1-1 to 1-3 and between sample Nos. 1-8 and 1-9).

(2) When a rare earth element is contained in at least one of the core wire and the covering, in particular, in the core wire, the change (amount of increase) in the mass is small, and oxidation resistance tends to enhance (for example, refer to and compare between sample Nos. 1-4 and 1-5 and refer to and compare among sample Nos. 1-10 to 1-12). With an increase in the content of the rare earth element, oxidation resistance tends to enhance (for example, refer to and compare between sample Nos. 1-11 and 1-12).

(3) With an increase in the covering ratio, the change (amount of increase) in the mass is small, and oxidation resistance tends to enhance (for example, refer to and compare between sample Nos. 1-1, 1-4, and 1-6 and sample Nos. 1-10, 1-13, and 1-15, refer to and compare between sample Nos. 1-8 and 1-17, and refer to and compare between sample Nos. 1-9 and 1-18).

(4) When the ratio (core wire/covering) in the grain size is large, the specific resistance tends to easily decrease (for example, refer to and compare between sample Nos. 1-1 and 1-2). One reason for this is considered to be relatively large crystal grains of the core wire. When the ratio (core wire/covering) is large, the core wire has relatively large crystal grains and thus has a good thermal conductivity. In view of this, the ratio (core wire/covering) is preferably large, here, 5 or more, further, more than 5. According to this test, the ratio (core wire/covering) can be adjusted to a certain extent by changing the heat treatment conditions, although it depends on the compositions, the degree of working, and the like. Here, with a decrease in the heating temperature during the heat treatment, the ratio (core wire/covering) tends to easily increase (for example, refer to and compare among sample Nos. 1-6, 1-1, and 1-112). Regarding sample No. 1-112, it is considered that crystal grains of both the core wire and the covering were coarsened by the high heating temperature during the heat treatment, and consequently, the ratio (core wire/covering) was 1.

(5) A diffusion layer formed between the core wire and the covering enables adhesion to be further enhanced. For example, the comparison among sample Nos. 1-1, 1-111, and 1-112 shows that, with an increase in the average thickness of the diffusion layer, the formation length of the oxide decreases. It is expected from these results that adhesion between the core wire and the covering is further enhanced by adjusting the thickness of the diffusion layer, and consequently, oxidation resistance is further enhanced, and good oxidation resistance is maintained for a long time as described above. In this test, the average thickness of the diffusion layer can be adjusted by changing the heat treatment conditions, although it depends on the compositions, the degree of working, and the like. With an increase in the heating temperature during the heat treatment, the average thickness tends to easily increase.

The test showed that an electrode material including a composite having a two-layer structure that includes a core wire having a high Ni content and a covering composed of a nickel alloy containing Cr and Al in specific ranges has a low specific resistance, good sparking wear resistance, and good oxidation resistance. It is expected that a spark plug electrode composed of this electrode material and a spark plug that includes this spark plug electrode have both good sparking wear resistance and good oxidation resistance.

The scope of the present invention is not limited to these examples but is defined by the appended claims, and is intended to cover all modifications within the meaning and scope equivalent to those of the claims.

For example, the composition, the shape, the size, and the like of the electrode material described in Test Example 1 can be appropriately changed.

REFERENCE SIGNS LIST

1 electrode material
10 composite
11 core wire
12 covering
13 diffusion layer
15 oxide
2 spark plug
20 electrode
20*e* end face
21 center electrode
22 ground electrode
25 insulator
26 metal shell
S test piece

The invention claimed is:

1. An electrode material comprising:

a composite including a core wire that is composed of a nickel base material containing 96% by mass or more of Ni and a covering that covers an outer peripheral surface of the core wire and that does not cover but exposes an end face of the core wire, wherein the covering is composed of a nickel alloy containing 10% by mass or more and 30% by mass or less of Cr and 0.1% by mass or more and 6% by mass or less of Al, the composite has a specific resistance of less than 50 μΩ·cm, and a ratio of a grain size of the nickel base material that forms the core wire to a grain size of the nickel alloy that forms the covering is 5 or more.

2. The electrode material according to claim 1, wherein in a cross section of the composite, an area ratio of a cross sectional area of the covering to a cross sectional area of the composite is 0.4 or more and 0.7 or less.

3. The electrode material according to claim 1, comprising a diffusion layer between the core wire and the covering, wherein a Ni content of the diffusion layer changes in a gradient manner.

4. The electrode material according to claim 1, wherein at least one of the nickel base material that forms the core wire and the nickel alloy that forms the covering contains 0.01% by mass or more and 0.7% by mass or less, in total, of a rare earth element.

5. The electrode material according to claim 1, wherein the nickel alloy that forms the covering contains, in terms of % by mass, 0.1% or more and 1.5% or less of Si,
0.1% or more and 0.6% or less of Mn,
10% or more and 30% or less of Cr,
0.1% or more and 6% or less of Al,
0.01% or more and 12% or less of Fe, and
0.01% or more and 0.6% or less of Ti, with the balance being Ni and inevitable impurities.

6. The electrode material according to claim 1, wherein the nickel base material that forms the core wire contains, in terms of % by mass, 0.01% or more and 1.5% or less of Si,
0% or more and 1.5% or less of Mn,
0.001% or more and 1.5% or less of Cr,
0.001% or more and 0.5% or less of Al,
0.01% or more and 1.5% or less of Fe, and
0% or more and 0.5% or less of Ti, with the balance being Ni and inevitable impurities.

7. A spark plug electrode composed of the electrode material according to claim 1.

8. A spark plug comprising the spark plug electrode according to claim 7.

9. An electrode material comprising:

a composite including a core wire that is composed of a nickel base material containing 96% by mass or more of Ni and a covering that covers an outer peripheral surface of the core wire and that does not cover but exposes an end face of the core wire, wherein the covering is composed of a nickel alloy containing 10% by mass or more and 30% by mass or less of Cr and 0.1% by mass or more and 6% by mass or less of Al, the composite has a specific resistance of less than 50 μΩ·cm, and the nickel alloy that forms the covering contains, in terms of % by mass, 0.1% or more and 1.5% or less of Si,
0.1% or more and 0.6% or less of Mn,
10% or more and 30% or less of Cr,
0.1% or more and 6% or less of Al,
0.01% or more and 12% or less of Fe, and
0.01% or more and 0.6% or less of Ti, with the balance being Ni and inevitable impurities.

10. The electrode material according to claim 9, wherein in a cross section of the composite, an area ratio of a cross sectional area of the covering to a cross sectional area of the composite is 0.4 or more and 0.7 or less.

11. The electrode material according to claim 9, wherein a ratio of a grain size of the nickel base material that forms the core wire to a grain size of the nickel alloy that forms the covering is 5 or more.

12. The electrode material according to claim 9, comprising a diffusion layer between the core wire and the covering, wherein a Ni content of the diffusion layer changes in a gradient manner.

13. The electrode material according to claim 9, wherein at least one of the nickel base material that forms the core wire and the nickel alloy that forms the covering contains 0.01% by mass or more and 0.7% by mass or less, in total, of a rare earth element.

14. The electrode material according to claim 9, wherein the nickel base material that forms the core wire contains, in terms of % by mass, 0.01% or more and 1.5% or less of Si,
0% or more and 1.5% or less of Mn,
0.001% or more and 1.5% or less of Cr,
0.001% or more and 0.5% or less of Al,
0.01% or more and 1.5% or less of Fe, and
0% or more and 0.5% or less of Ti, with the balance being Ni and inevitable impurities.

15. An electrode material comprising:

a composite including a core wire that is composed of a nickel base material containing 96% by mass or more of Ni and a covering that covers an outer peripheral surface of the core wire and that does not cover but exposes an end face of the core wire, wherein the covering is composed of a nickel alloy containing 10% by mass or more and 30% by mass or less of Cr and 0.1% by mass or more and 6% by mass or less of Al, the composite has a specific resistance of less than 50 μΩ·cm, and the nickel base material that forms the core wire contains, in terms of % by mass, 0.01% or more and 1.5% or less of Si,
0% or more and 1.5% or less of Mn,
0.001% or more and 1.5% or less of Cr,
0.001% or more and 0.5% or less of Al,
0.01% or more and 1.5% or less of Fe, and
0% or more and 0.5% or less of Ti, with the balance being Ni and inevitable impurities.

16. The electrode material according to claim 15, wherein in a cross section of the composite, an area ratio of a cross sectional area of the covering to a cross sectional area of the composite is 0.4 or more and 0.7 or less.

17. The electrode material according to claim 15, wherein a ratio of a grain size of the nickel base material that forms the core wire to a grain size of the nickel alloy that forms the covering is 5 or more.

18. The electrode material according to claim 15, comprising a diffusion layer between the core wire and the covering, wherein a Ni content of the diffusion layer changes in a gradient manner.

19. The electrode material according to claim 15, wherein at least one of the nickel base material that forms the core wire and the nickel alloy that forms the covering contains 0.01% by mass or more and 0.7% by mass or less, in total, of a rare earth element.

* * * * *